United States Patent [19]

Moreau

[11] 4,358,907

[45] Nov. 16, 1982

[54] COMPACT MANUFACTURING SYSTEM FOR FORMING SOFT GOODS MAINLY TOYS

[76] Inventor: Claude R. M. Moreau, 85-06 60th Ave., Elmhurst, N.Y. 11373

[21] Appl. No.: 223,423

[22] Filed: Jan. 8, 1981

Related U.S. Application Data

[63] Continuation of Ser. No. 129,723, Mar. 12, 1980, which is a continuation of Ser. No. 832,602, Sep. 12, 1977, abandoned.

[51] Int. Cl.[3] ..... A63H 3/02

[52] U.S. Cl. ..... 46/158

[58] Field of Search ..... 46/151, 156, 157, 158, 46/159, 160, 1 L; 69/19, 19.1, 19.2, 19.3

[56] References Cited

U.S. PATENT DOCUMENTS

| | | | |
|---|---|---|---|
| 868,033 | 10/1907 | Thorer | 69/19.3 |
| 1,180,591 | 4/1916 | Lee | 46/157 |
| 1,287,154 | 12/1918 | Wells | 46/158 |
| 1,464,762 | 8/1923 | Hayward | 69/19.2 |
| 1,485,638 | 3/1924 | Smith | 46/158 |
| 1,673,759 | 6/1928 | Smith | 46/158 |
| 1,681,031 | 8/1928 | Forbis | 46/158 |
| 1,698,653 | 1/1929 | Poole | 46/158 |
| 1,819,295 | 8/1931 | Holt | 46/158 |
| 1,847,333 | 3/1932 | Dunn | 69/19 X |
| 2,170,953 | 8/1939 | Spots | 46/157 |
| 2,289,858 | 7/1942 | Angrave | 46/157 X |
| 2,412,321 | 12/1946 | Chu et al. | 46/156 |
| 3,439,444 | 4/1969 | Smith | 46/1 L |

FOREIGN PATENT DOCUMENTS

| | | | |
|---|---|---|---|
| 559882 | 6/1923 | France | 69/19.1 |
| 378689 | 2/1940 | Italy | 46/1 L |

*Primary Examiner*—F. Barry Shay

*Attorney, Agent, or Firm*—Jacobs & Jacobs

[57] ABSTRACT

A manufacturing system for soft goods having intricate curved configurations such as three dimensional toys that compacts and consolidates in a one-piece blank all the pattern parts for the manufacture of the toy where all the pattern parts use the same fabric material. The system includes a generally rectangular fabric blank having halve portions which are substantially mirror images of each other with respect to a median line, the blank providing maximum economy in the cutting and utilization of fabric material. The blank generally includes integrally formed body and leg-forming portions and may also include integrally formed head, ear and tail forming portions. The forming portions are appropriately shaped so that upon forming the blank into the toy, edges of corresponding forming portions mate with each other to enable the toy to be manufactured with a minimum number of seams and pieces. One-piece head forming blanks are also disclosed for use with blanks which, when formed, provide a body for a soft toy.

6 Claims, 23 Drawing Figures

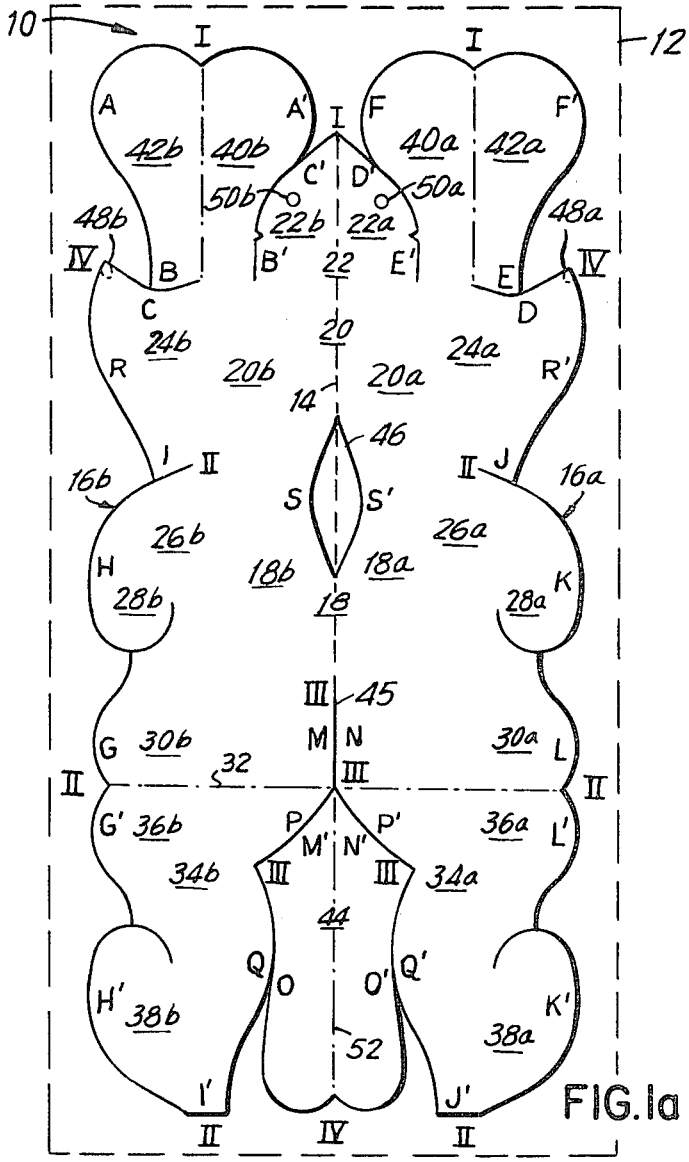
FIG.1a
FIG.1b
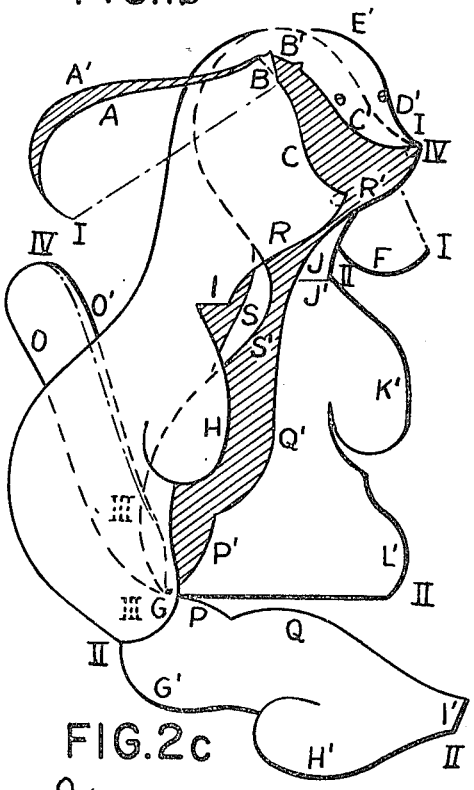
FIG.2c
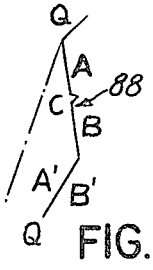
FIG.2d
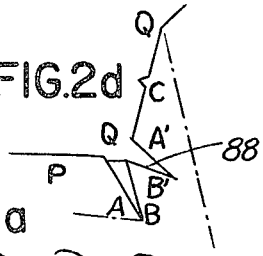
FIG.2a
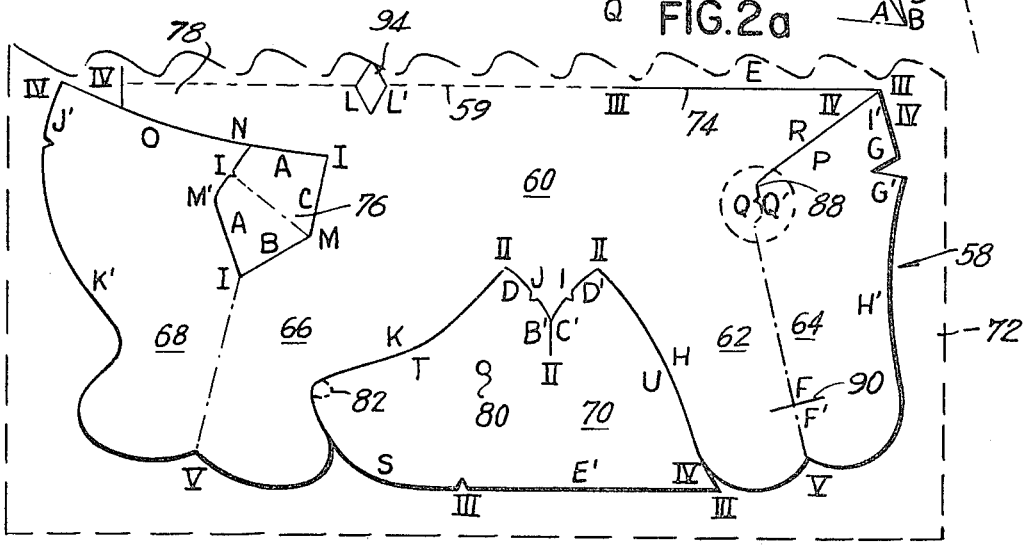

FIG.3a
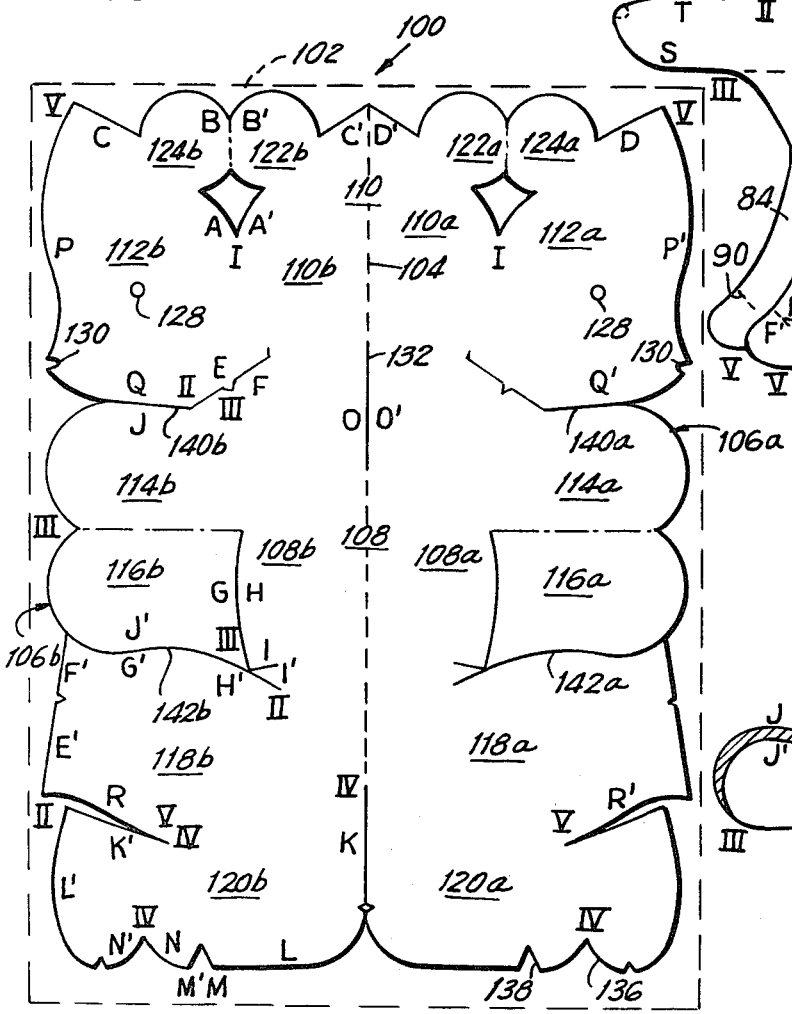
FIG.2b
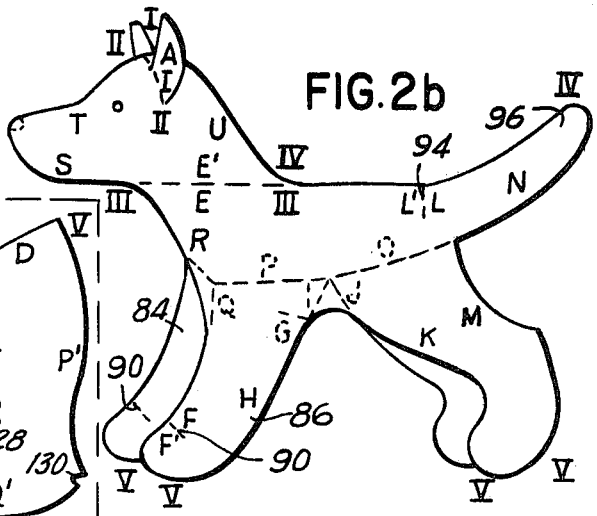
FIG.3b
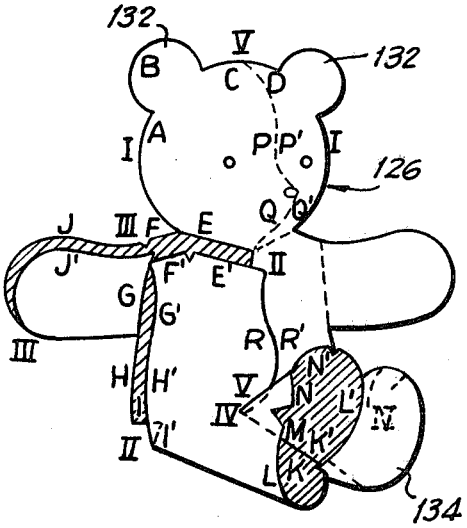
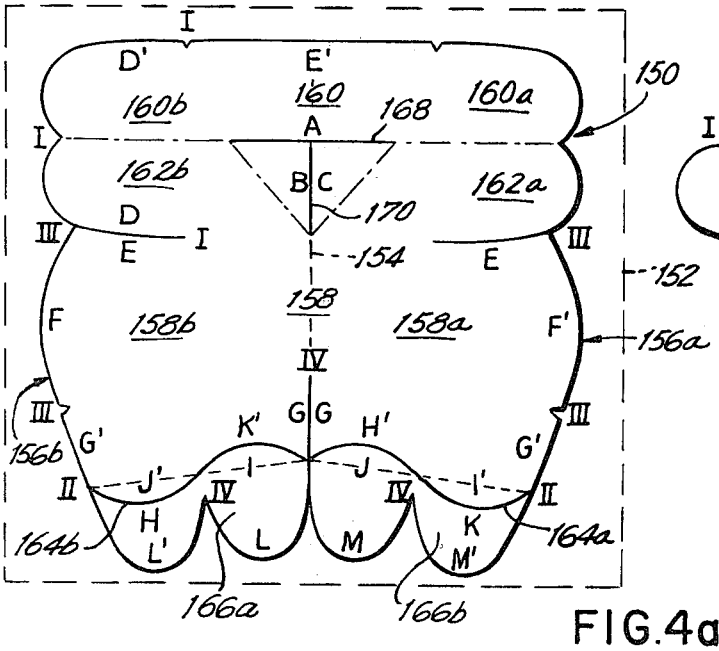
FIG.4a
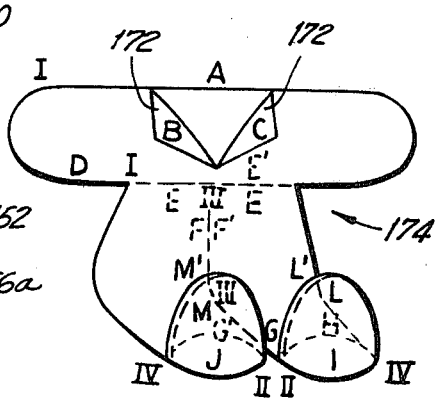
FIG.4b

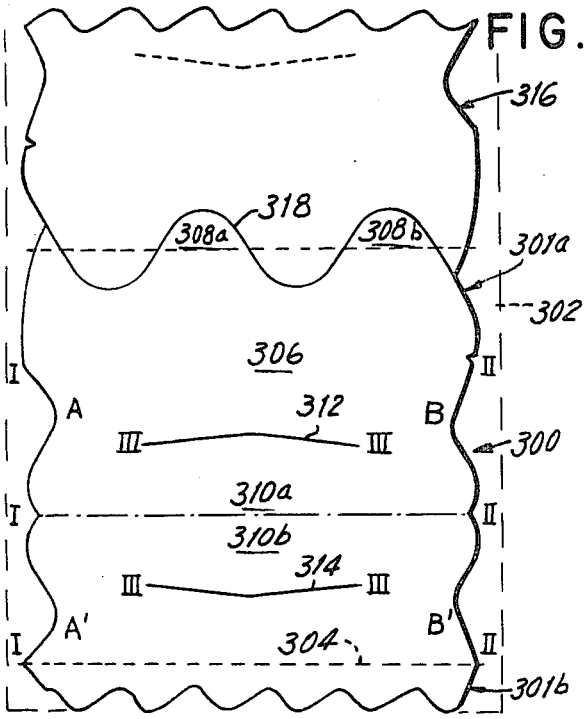
FIG.8a
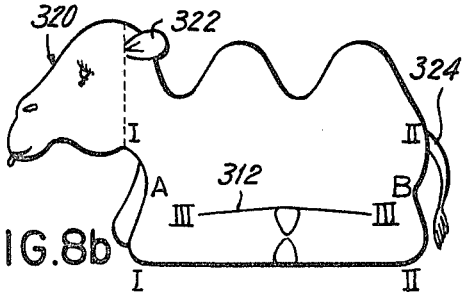
FIG.8b
FIG.9a
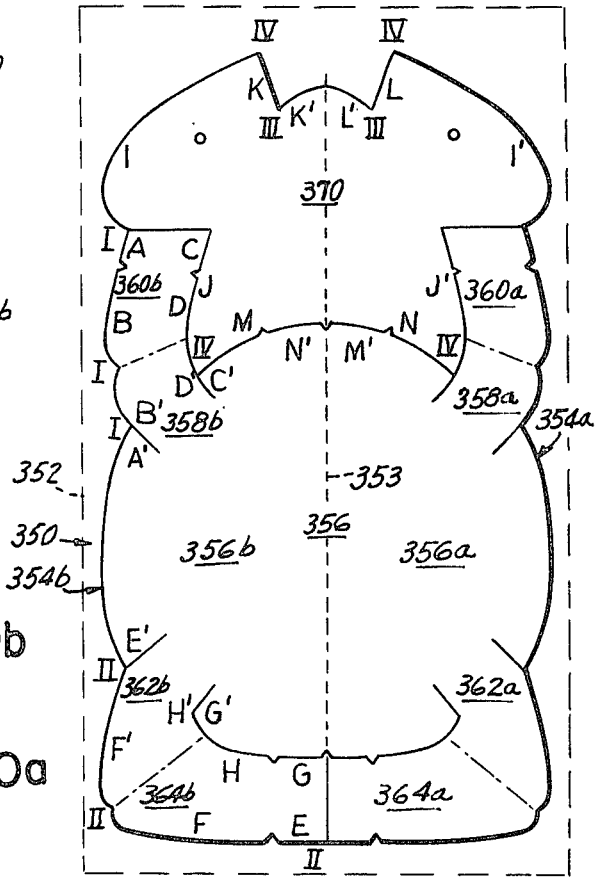
FIG.9c
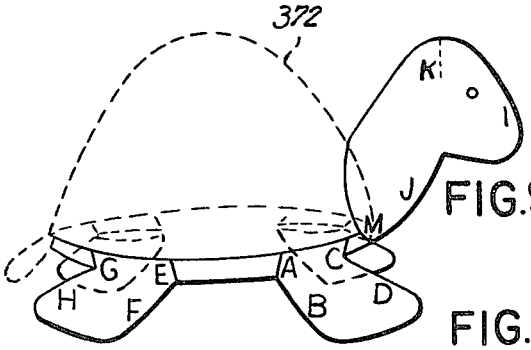
FIG.9b
FIG.10a
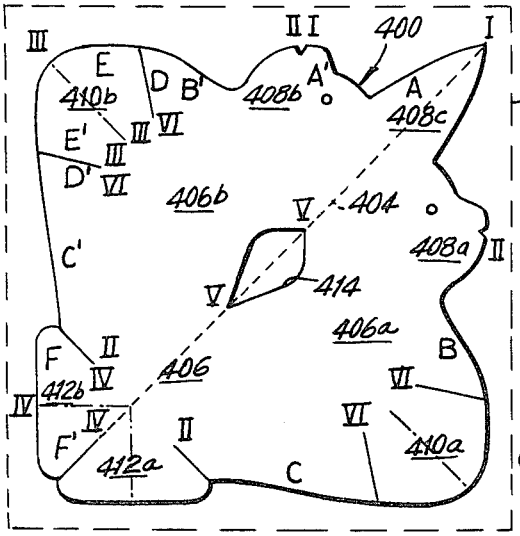
FIG.10b
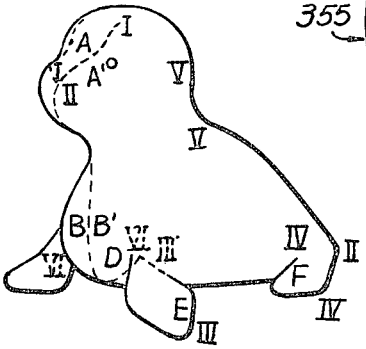
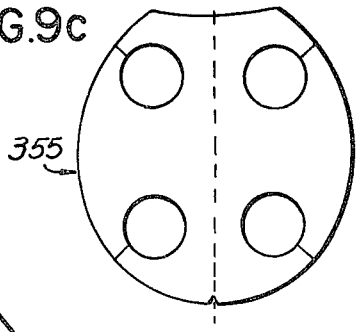

COMPACT MANUFACTURING SYSTEM FOR FORMING SOFT GOODS MAINLY TOYS

CROSS REFERENCE

This is a continuation of Ser. No. 129,723 filed Mar. 12, 1980, which is a continuation of Ser. No. 832,602 filed Sept. 12, 1977, now abandoned.

BACKGROUND OF THE INVENTION

This invention relates, generally, to a compact system for the manufacture of soft goods having intricate curved configurations, and more particularly, to a one-piece blank or pattern for forming soft toys, such as stuffed animals, or portions thereof which provide maximum economy in the cutting and utilization of fabric material as well as in the labor involved in seaming the blank. Although the following describes the invention in terms of the system for the manufacturing of soft or stuffed toys, it is understood that the present invention is not so limited, but may also be used in the manufacture of other soft goods having intricate curved configuration.

Heretofore, in the manufacture of stuffed toys of the three dimensional type, such as, for example, stuffed animals, separate fabric blanks have been cut, each corresponding to a separate portion of the toy. For example, in the manufacture of a stuffed dog, separate blanks have been cut for each leg (paw), for the body, for each ear and for the tail. The cutting of such blanks is usually accomplished by single dies or ganged dies comprising a series of dies welded together. Such dies require spacing of at least approximately one-quarter inch between each die in order to avoid pressure points which would inhibit a clean cut of the fabric material. This die cutting approach also required all acute angles on each pattern to be formed on the outside of the pattern, among other things.

Upon cutting the plurality of patterns corresponding to each portion of the stuffed toy, each toy portion must then be individually formed by seaming and appropriately joined to each other. The toy is then reversed or turned out and stuffed. At this time whenever a seam occurs, the fabric material must be brushed in order to hide such seam. When the toy requires many seams, the brushing operation becomes quite time consuming. For example, to form a stuffed animal of the type illustrated in FIG. 3*b* by conventional methods requires at least fifteen individual pieces and fifteen seams as compared with 1 piece and 8 seams for the present invention.

In addition to the inordinate labor required in the construction of a stuffed toy according to conventional methods, much of the fabric material from which the blanks are cut is wasted due to the fact that the separate blanks each have a configuration which does not permit their being layed out in an efficient manner on the fabric. Thus, it is not uncommon to find a relatively large amount of wasted fabric between two or more blanks in a particular layout.

Accordingly, it can be seen that the assembly of stuffed toys has heretofore resulted in much wasted fabric material as well as the necessity for time consuming labor operations required from the large number of rather intricate sewing operations.

SUMMARY OF THE INVENTION

Accordingly, one object of the present invention is to provide a new and improved one-piece blank for forming three dimensional toys or portions thereof.

Another object of the present invention is to provide a new and improved one-piece blank of the type described having a generally rectangular shape resulting in the efficient use of fabric material.

Still another object of the present invention is to provide a new and improved one-piece blank of the type described defined by a pair of halve portions which are substantially mirror images of each other.

Still another object of the present invention is to provide a new and improved integrally formed one-piece blank for forming the major portion of the toy.

Another object of the present invention is to provide a blank for forming stuffed toys wherein the head portion of the toy is formed by the same knife cut of the die which forms the leg portions thereof.

Still yet another object of the present invention is to provide a one-piece blank for forming three-dimensional toys or portions thereof wherein a single cut in the fabric blank defines a jig-saw puzzle relationship between substantial portions of the edges of two separate and distinct toy forming portions.

Briefly, in accordance with the present invention, these and other objects are obtained by providing a one-piece fabric blank having a generally rectangular configuration and having halve portions which are substantially mirror images of each other with respect to an imaginary median line. Generally, the body forming portion is centrally situated. The limb forming portions such as those portions forming the upper or front legs (paws) and the lower or rear legs extend from and are integral with the body forming portion. Again generally, each such limb forming portion includes a first portion extending from and integral with the body portion and a second portion extending from and integral with the first portion. Alternatively, the second limb forming portion may extend integrally from the body portion at a location remote from the first limb forming portion. When provided, head forming portions may extend from and be integral with the body forming portions. Similarly, ear forming portions may extend from respective head forming portions.

Whenever possible, portions for defining different parts of the toy are formed by the same knife cut. Thus, for example, a single knife cut may define both a leg portion and a head portion or a leg portion and a tail portion of the blank.

An opening or slit within the blank is provided, usually on the median line, to permit stuffing the toy after its formation from the blank as well as additional shaping of the toy.

Edges of corresponding portions of the blank are usually similarly shaped so that during formation of the toy, these edges are brought together and seamed. However, mating portions need not be similarly shaped but, rather, may be of different shapes so that upon being brought together there is a reforming or reconstitution of the portion. Further, for various toys, portions may be cut from the blank and exchanged in position with other portions similarly formed in the blank.

One-piece fabric blanks are also provided for forming the entire head of a stuffed toy. Openings may be provided in such blanks so that material of a different color or type may be incorporated therein when desired. The various heads formed are advantageously used in many toys made with a body portion intended for use with interchangeable heads.

DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein:

FIG. 1*a* is a plan view of a first embodiment of a one-piece blank according to the present invention;

FIG. 1*b* is a perspective view of a stuffed animal in partially assembled form constructed from the blank illustrated in FIG. 1*a;*

FIG. 2*a* is a partial plan view of a one-piece blank according to a second embodiment of the present invention;

FIG. 2*b* is a stuffed animal formed from the blank illustrated in FIG. 2*a;*

FIG. 2*c* is an enlarged detailed view of a portion of the pattern shown in FIG. 2*a;*

FIG. 2*d* is a detailed view of a step in the construction of the animal from the blank illustrated in FIG. 2*a;*

FIG. 3*a* is a plan view of a one-piece blank according to a third embodiment of the present invention;

FIG. 3*b* is a perspective view of a stuffed animal in partially assembled form constructed from a blank as illustrated in FIG. 3*a;*

FIG. 4*a* is a plan view of a one-piece blank according to a fourth embodiment of the present invention;

FIG. 4*b* is a portion of a stuffed animal in assembled form constructed from the blank illustrated in FIG. 4*a;*

FIG. 8*a* is a plan view of a portion of a one-piece blank illustrating another embodiment of the present invention;

FIG. 8*b* is a perspective view of a stuffed animal in assembled form constructed from a blank as illustrated in FIG. 8*a;*

FIG. 9*a* is a plan view of a one-piece blank illustrating still another embodiment of the present invention;

FIG. 9*b* is a perspective view of a stuffed animal in assembled form constructed from a blank as illustrated in FIG. 9*a.*

FIG. 9*c* is a plan view of a prior art blank used in the construction of a stuffed animal similar to that shown in FIG. 9*b;*

DESCRIPTION OF THE PREFERRED EMBODIMENTS

Figure 5A:
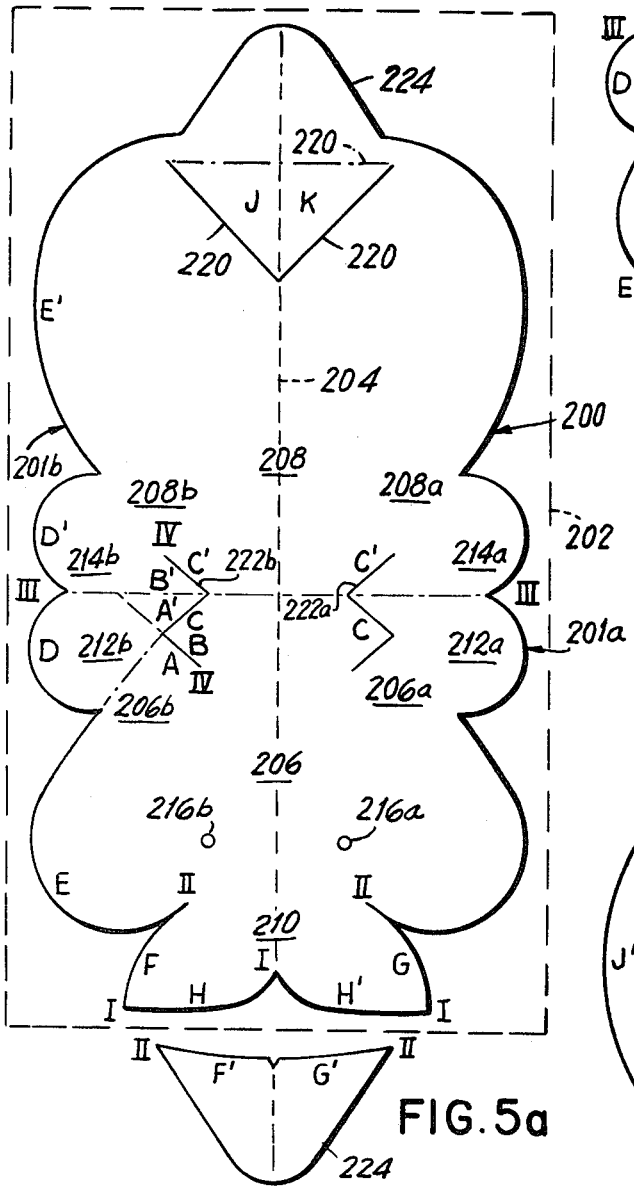
FIG. 5*a* is a plan view of a one-piece blank for forming a head portion of a stuffed toy according to a fifth embodiment of the present invention.

Referring now to the drawings, each of the embodiments is illustrated by including a plan view of the one-piece blank and at least one other view showing the stuffed toy constructed therefrom in assembled or partially assembled form. In each case, the upper case letters found on each of the drawings indicates the manner in which the blank is to be folded to obtain the constructed toy. More particularly, each upper case letter associated with a plan view of a blank is one of a pair, including an upper case letter and the same uppercase letter, primed (for example, A, A'). In each case, those portions of a blank designated by a pair of letters are to be brought together into mating relationship during the construction of the toy. Thus, for example, that portion of a blank marked A is brought into mating contact with the corresponding portion of the blank marked A'.

Each of the illustrations also has associated therewith several sets of Roman numerals. Each set of such Roman numerals indicates that a separate seam is to be provided on the mating edges of the blank defined between these Roman numerals. Thus, for example, in FIGS. 1*a* and 1*b,* a seam is provided at the mating edges of the blank extending between the Roman numerals I.

Additionally, in the description of the actual construction of a stuffed toy from a blank, when reference is made to "folding" the blank, it is to be understood that a fabric blank is not folded in the sense that a piece of paper is folded with a crease being formed along a so-called fold line. Instead, when reference is made to "folding" the blank with respect to a "fold line", it is understood that the fabric is merely being manipulated in the usual sense with respect to a particular reference point, without forming any creases or the like.

Finally, in the plan view of the blanks, solid lines represent actual edges of the blank cut by a die, dashed lines are imaginary reference lines and dash-dot lines are "fold lines" within the meaning discussed immediately hereinabove.

Again referring to the drawings, and more particularly to FIGS. 1*a* and 1*b,* a one-piece fabric blank, generally denoted as 10, comprises a first embodiment of the present invention. This blank is shaped to form a stuffed animal of the sitting dog type whose general configuration may be seen in FIG. 1*b.* Blank 10 is substantially rectangular in shape as seen by the dotted line 12 which substantially follows the outer contour of blank 10. From line 12, it may be seen that a maximum number of blanks 10 can be cut from a single piece of fabric due to the minimum of wasted material. Thus, considering line 12 as defining the amount of fabric required for blank 10 (one-quarter inch clearance being necessary between adjacent blanks) it is understood that a series of such blanks may be efficiently cut from a long piece of fabric. It is also noted that the entire one-piece blank 10 and the tail forming portion 44, described below, will form the entire stuffed animal thereby dispensing with the need for a multiplicity of patterns for each animal with the consequent waste of material and high labor costs discussed above.

Blank 10 is longitudinally bisected by an imaginary median line 14 thereby dividing the blank 10 into halve portions 16*a,* 16*b.* In blank 10 (as well as in all the illustrated embodiments) halve portions 16*a,* 16*b* are substantial mirror images of each other. This results in the simplification of the design of the cutting die which forms the blank as well as simplifying the construction of the stuffed toy.

Blank 10 includes a rear body-forming portion 18 and a rear head-forming portion 20 upwardly extending from and integral with the rear body-forming portion 18. An upper head-forming portion 22 extends upwardly from and is integral with said rear head-forming portion 20.

Median line 14 bisects the rear body and head-forming portions 18, 20 and upper head-forming portion 22 into right and left sub-portions designated by the respective indicia a,b, respectively. Similarly, corresponding right and left portions of the blank will hereafter be marked by the same numeral, a and b, respectively.

Right and left side head-forming portions 24*a*, 24*b* extend from and are integral with right and left head-forming sub-portions 20*a*, 20*b*. Right and left side body-forming portions 26*a*, 26*b* extend from and are integral with right and left side rear body-forming sub-portions 18*a*, 18*b*. Right and left upper leg-forming first portions 28*a*, *b* extend from and are integral with right and left side forming portions 26*a*, *b*, respectively. Right and left lower leg-forming first portions 30*a*, *b*, extend from and are integral with right and left side body-forming portions a, b, respectively.

The lower boundary of the right and left lower leg-forming first portions 30*a*, *b* and the rear body-forming portion 18 is defined by a transversely extending imaginary fold line 32.

Right and left front body-forming portions 34*a*, *b* extend downwardly from fold line 32 and are integral with the right and left rear body-forming sub-portions 18*a*, 18*b*, respectively. Right and left lower leg-forming second portions 36*a*, *b*, integrally extend from right and left front body-forming portions 34*a*, *b*, respectively. Similarly, right and left upper leg-forming second portions 38*a*, 38*b* integrally extend from right and left front body-forming portions 34*a*, *b*, respectively.

Should it be desired to provide ears for the stuffed toy in an integral manner, this may be easily accomplished. In blank 10, right and left ear forming first portions 40*a*, *b*, extend upwardly from and are integral with right and left side head-forming portions 24*a*, *b*, respectively. Similarly, right and left ear forming second portions 42*a*, *b*, laterally extend from and are integral with right and left ear-forming first portions 40*a*, *b*, respectively.

Blank 10 is advantageously formed so that a portion of the inwardly facing edges of right and left front body-forming portions 34*a*, *b*, define a portion of the outer edges of a tail-forming portion 44 which is separately cut from the fabric material. However, as is clear from FIG. 1*a*, a separate die is not necessary to cut tail-forming portion 44 and there is a minimum of wasted material when the blank is formed. Similarly, edges of upper head-forming portion 22 define edges of right and left ear forming first portions 40*a*, *b*, while the edges of side forming portions 26 and front body-forming portions 34 at least partially define the edges of upper leg-forming first portions 28 and upper leg-forming second portions 38, respectively. The feature whereby a single cut defines the edges of two distinct portions of the blank is common to all the embodiments of the invention and provides an efficiency in the use of material not heretofore possible.

Finally, several openings or notches are formed in the blank 10 for various reasons. An opening 46 is formed symetrically about median line 14 through which stuffing may be inserted into the toy subsequent to the seaming operation. More importantly however, opening 46 is formed such that upon being seamed closed, the contour of the neck and the back comprising the rear body of the stuffed animal is drawn in and shaped. Notches 48*a*, *b*, are provided at the outer extremities of right and left side head-forming portions 24*a*, *b*, to accomodate the fastening of a nose member to the stuffed toy subsequent to its formation. Similarly, right and left openings 50*a*, *b*, are formed in right and left upper head forming sub-portions 22*a*, 22*b* to facilitate the fastening of eye members thereto subsequent to the formation of the stuffed toy.

In the construction of the stuffed toy from blank 10, referring to FIG. 1*a* in conjunction with FIG. 1*b*, corresponding portions of the blank are brought into mating contact so that their corresponding edges may be seamed together. As noted above, corresponding blank portions are noted on the drawings by pairs of identical upper case letters, one being primed. Thus, for example, the left ear is formed by bringing the portion marked A on left ear-forming second portion 42*b* into abutting relationship with the portion of left ear-forming first portion 40*b* marked A'. The outer edges mate and are subsequently seamed, which seam is denoted by Roman numeral I in FIG. 1*a*. In general, blank 10 is folded along the transversely extending fold line 32 whereby corresponding blank portions abut each other so that their outer edges can be seamed. Referring to FIG. 1*b*, it is seen that the head of the stuffed toy is formed by bringing together the upper head forming portion 22 and the right and left head-forming portions 24*a*, *b*.

From the above discussion, one of ordinary skill in the art will readily understand the manner in which the blank is to be folded in order to construct the stuffed toy. Suffice to say, generally, that corresponding portions of the blank are folded into abutting relationship as indicated by the pairs of letters marked on FIG. 1*a* with the mating edges seamed. The Roman numerals indicate the number and extent of the seaming operations. Subsequent to seaming, the entire sewn blank is reversed or turned inside out so as to hide the seams. Stuffing material is then introduced into the interior through opening 46. Eye member are fastened at right and left openings 50*a*, *b* and a nose member fastened at notches 48*a*, *b*. The tail portion 44 is attached to the main blank prior to seaming at III—III, an opening to its interior being provided by a slit 45. Thereafter, tail portion 44 is seamed, reversed and stuffed together with the remainder of the blank.

Turning now to the second embodiment of the present invention shown in FIGS. 2*a*, through 2*d*, a portion of a one-piece fabric blank 58 for forming a stuffed animal of the standing dog type is illustrated. As in the case of the first embodiment, a median line 59 bisects 58 into right lower and left upper halve portions. Only the right lower halve portion of blank 58 is illustrated in FIG. 2*a*. However, it is understood that the left halve portion is a mirror image of the right halve portion with respect to a median line 59. Accordingly, the description of the right halve portion of the blank applies in a corresponding manner to the left halve portion which is not shown.

The right halve portion of blank 58 includes a body forming portion 60. A front leg-forming first portion 62 extends downwardly and forwardly from and is integral with body forming portion 60. A front leg-forming second portion 64 extends transversely from and is integral with the front leg-forming first portion 62.

Similarly, a rear leg-forming first portion 66 extends downwardly from and is integral with the body-forming portion 60. A rear leg-forming second portion 68 extends transversely from and is integral with rear leg-forming portion 66.

Unlike the blank comprising the first embodiment, blank 58 includes a tail-forming portion 78 which is integral with and extends rearwardly from body-forming portion 60 and, like the first embodiment, openings 80 and notches 82 are provided for attachment of eye and nose members subsequent to construction of the stuffed toy from blank 58.

The applicant has found that in the case of patterns for standing dogs and similar type stuffed toys of the class which stand on four legs, the area between the front and rear leg-forming first portions 62, 66 provides an ideal area from which a head-forming portion may be obtained. Accordingly, a head-forming first portion 70 is defined between the front and rear leg-forming first portions 62, 66 with the inwardly facing edges thereof corresponding to the outer edges of a substantial portion of the perimeter of head-forming first portion 70 and are formed by a single cut in the material. Of course, it is understood that a similar head portion will be provided between the corresponding leg portions of the left halve portion of blank 58. It is also noted that a single cut defines edges of rear leg-forming second portion 68 and tail-forming portion 78, resulting in a compactness of the pattern and consequent increased material cost reduction.

As was the case with respect to the first embodiment, the one-piece blank 58 of the second embodiment has a substantially rectangular outer configuration as indicated by dotted line 72. However, it should also be noted that the assembly of the blank 58 does not result in a completed toy as in the case of the assembly of blank 10 of the first embodiment. Rather, the head portions 70 must be constructed and subsequently attached to the body portion of the toy. This is preferably accomplished by providing a cut 74 along a limited length of median line 59 providing a fabric edge to which corresponding edges on the head portion may be seamed.

Further, the fabric area 76 defined between the body-forming portion 60 and the rear leg-forming first and second portions 66, 68 provides ear-forming portions which, like head-forming portion, are separately formed and attached to the head of the stuffed animal after construction.

In the construction of the standing dog type stuffed animal from blank 58, corresponding blank portions intended to be brought into mutual abutting relationship so that the outer edges thereof mate for subsequent seaming are denoted by indicia similar to that in connection with the first embodiment, described hereinabove.

The following additional details should be noted in the construction of the standing dog type stuffed animal as seen in FIG. **2*b* from blank 58. It is desirable to provide a space between the tops of front legs 84, 86 (See FIG. 2*b*). This is accomplished by providing a cut 88 (FIGS. 2*a, c, d*) between the front leg-forming first and second portions 62, 64. Cut 88 is shown in detail in FIG. 2*c* and the manner of folding the blank at cut 88 is shown in FIG. 2*d*. In FIGS. 2*c* and 2*d*, additional folding indicia letter are added and are not to be confused with those used in FIG. 2*a*. Thus, as shown in FIGS. 2*c* and *d***, a small crimp is formed when portions of the blank corresponding to A, A' and B, B' are folded upon each other, which crimp provides fabric area between the upper portions of the front legs.

Referring to FIGS. **2*a* and *b*, cuts 90 are formed extending between the front leg-forming first and second portions. This allows the tips of the front legs to be shaped forwardly as seen in FIG. 2*b*. Similarly, an area 94 is cut out along median line 59 as seen is FIG. 2*a*. This permits an upward positioning of the tail 96**.

The head portion of the stuffed toy is formed in a substantially similar manner as is the body portion, namely by bringing corresponding portions of the head portions 70 together as indicated by matching letters and seaming the edges together. The ear-forming portions 76 are appropriately positioned as indicated by the letters and seamed. Thereafter, both the toy body and the toy head are reversed or turned inside out and stuffed. The head is attached to the body at cut 74 and the matching edges on the head.

Turning now to the third embodiment of the invention, shown in FIGS. **3*a* and 3*b*, a one-piece fabric blank, generally denoted as 100 is illustrated, for constructing a stuffed toy of the type generally known as a "teddy" bear. As can be seen, the outermost edge of blank 100 lies close to the edge of a rectangular area denoted by dotted line 102. In this sense fabric blank 100** has a substantially rectangular configuration, similar to the first and second embodiments. As was the case with respect to the first and second embodiments, this rectangular configuration results in a tremendous reduction in wasted material with consequent savings in costs relative to prior art patterns.

An imaginary median line 104 longitudinally bisects blank 100 into right and left halve portions **106*a, b*** respectively, which are substantially mirror images of each other. This is common to all embodiments of the present invention.

The blank includes a rear body-forming portion 108 which median line 104 bisects into right and left rear body-forming sub-portions **108*a, b*. Extending upwardly from and integral with rear body-forming portion 108 is rear head-forming portion 110, which median line 104 bisects into right and left rear head-forming sub-portions 110*a, b*. Laterally extending from and integral with right and left rear head-forming sub-portions 110*a, b*, are right and left front head-forming portions 112*a, b*, respectively. Extending laterally from right and left rear body-forming sub-portions 108*a, b*, are right and left rear arm-forming portions 114*a, b*, respectively. Similarly, extending downwardly from and integral with the right and left rear arm-forming portions 114*a, b*, are right and left front arm-forming portions 116*a,b***, respectively.

Integral with and extending from right and left rear body-forming sub-portions **108*a, b*, are right and left front body-forming portions 118*a, b*. Right and left leg-forming portions 120*a, b*, extend from and are integral with right and left front body-forming portions 118*a, b***, respectively.

Finally, right and left rear ear-forming portions **122*a, b*, are integrally formed with and extend from right and left rear head-forming sub-portions 110*a, b*, respectively while right and left front ear-forming portions 124*a,b*, are integral with and extend from right and left front head-forming portions 112*a, b*, respectively, the former being integral with right and left rear ear-forming portions 122*a, b***.

One-piece blank 100, when folded according to the letter indicia marked on FIG. **3*a* described hereinabove, forms the stuffed animal, 126, shown in FIG. 3***b* in its entirely. As in the case with the first two embodiments described hereinabove, a minimum number of seams are required subsequent to bringing corresponding portions of blank 100 into abutting relationship with the edges there of in mating position.

Openings 128 and notches 130 are provided in the front head-forming portions 112 to provide means to which eye and nose members respectively, can be connected to the stuffed animal 126. Further, a cut 132 is provided along median line 104 to provide access to the interior of stuffed animal 126 subsequent to seaming and reversing, i.e., turning the constructed animal inside out for stuffing material.

In the present case, the ears 132 of stuffed animal 126 are intended to be formed of the same material as the remainder of the animal and, accordingly, ear-forming portions 122, 124 are provided integrally with blank 100.

The embodiment of the invention shown in FIGS. 3*a* and *b* comprises a design for forming a stuffed animal toy 126 which applicant has found to be particularly advantageous insofar as providing efficient use of material form which blank 100 is cut. More particularly, referring to right and left leg-forming portions 120*a, b*, (FIG. 3*a*) and with further reference to FIG. 3*b*, it is noted that each such leg-forming portion, by itself, forms a corresponding leg 134 on stuffed animal 126. It is noted, however, that each leg-forming portion 120 is not symmetrical, but rather, is irregularly shaped. Applicant has found that by providing appropriately spaced notches 136, 138, that the material from which blank 100 is formed may be misshapen and appropriately folded to provide a leg portion which is suitable for the particular toy with which it is employed. This so-called "shape-reconstitution design" allows for both efficient use of the material and a wide variety of possible configurations for the toy.

It is again noted that the edges of various adjacent portions of the blank are formed by single cuts in the material producing a sort of jig-saw puzzle relationship between said portions at these edges. For example, edges of the front head-forming portions 112 and rear arm-forming portions 114 are defined by a single cut. Similarly, the edges of front arm-forming portions 116 and front body-forming portions 118 are formed by a single cut. The cuts are shown at 140*a, b* and 142*a,b*. As mentioned hereinabove, this feature of the present invention wherein various parts of the blank are formed by a single cut of the die results in a compactness of the blank and consequent material savings not heretofore possible using prior art patterns.

Referring now to FIG. 4*a* and 4*b* which illustrate a fourth embodiment of the present invention, a one-piece blank 150 is illustrated which, when folded as shown in FIG. 4*b*, forms the body only of a bear type stuffed animal. As seen in FIG. 4*a*, blank 150 is substantially rectangularly shaped as illustrated by dotted line 152 which as in the cases of the previously discussed embodiments, may represent the piece of fabric from which blank 150 is cut. An imaginary median line 154 extends longitudinally across blank 150 dividing the same into respective right and left halve portions 156*a, b*. As in the cases of the previous embodiments, halve portions 156*a, b*, are substantial mirror images of each other.

Blank 150 includes a body-forming portion 158 and, extending upwardly from and integrally therewith rear arm-forming portion 160. Median line 154 bisects body-forming portion 158 and rear arm-forming portion 160 into right and left body-forming sub-portions 158*a, b* and right and left rear arm-forming sub-portions 160*a, b*. Integrally extending from right and left body-forming sub-portions 158*a, b* and also integral with right and left arm-forming sub-portions 160*a, b*, are right and left front arm-forming portions 162*a, b*, respectively.

In forming stuffed toys wherein the terminal portion of the legs are intended to extend upwardly when the stuffed toy is in a sitting position, such as a stuffed toy constructed using the body illustrated in FIG. 4*b*, and where these terminal portions are to be of any desired length, applicant has discovered that this may be efficiently accomplished by a pair of die cuts 164*a, b*, each having a substantially sinusoidal configuration. More particularly, right and left leg-forming portions 166*a, b*, are defined by die cuts 164*b, a*, respectively. It is noted that the right leg-forming portion 166*a* is formed on the left side of the blank while the left leg-forming portion 166*b* is formed on the right side. In the construction of the stuffed animal, described below, these leg-forming portions are reversed with respect to median line 154 and are attached to the appropriate edges of the front body-forming portions 158*a, b*, as denoted by the upper case letter indicia described above. This technique may be referred to an "exchange of areas".

A T-shaped pair of die cuts 168, 170 are formed in blank 150, the former being centrally provided along the fold line between front and rear arm-forming portions 160, 162 and the latter being provided along median line 154. Upon construction of the stuffed animal, cuts 168, 170 define a pair of flaps 172 (FIG. 4*b*) for providing means for attaching the head portion of the stuffed animal. These flaps thus define an "inner neck opening".

It is again noted that pattern 150 is extremely compact and includes a minimum of wasted material due, at least in part, to the fact that single die cuts define edge portions of various parts of blank 150. More particularly, a single die cut defines edge portions of right and left front arm-forming portions 162*a, b* and right and left body-forming portions 158*a, b*, respectively. Further, single cuts define edge portions of right and left body-forming portions 158*a, b* and left and right leg-forming portions 166*b, a* respectively.

Blank 150 is "folded" according to the upper case letter indicia in the manner described hereinabove with respect to the previously described embodiments. The folded blank is then seamed according to the Roman numeral indicia marked thereon, turned inside out and stuffed with stuffing material.

Figure 5B:
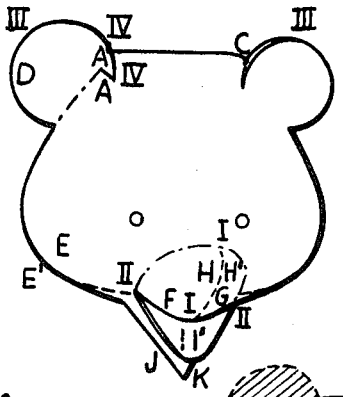
FIG. 5*b* is a perspective view of a head portion of a stuffed toy in assembled form constructed using the blank shown in FIG. 5*a;*

Turning now to FIGS. 5 and 6, one-piece blanks are illustrated for forming the heads of three dimensional stuffed toys, which heads are particularly adapted to be used with bodies formed, for example, as shown in FIG. 4. It is understood, however, that the heads formed by the blanks shown in FIGS. 5 and 6 can be used with a body formed using the principles of this invention or, alternatively using prior art techniques.

Referring to FIGS. 5*a* and *b*, a one-piece blank 200 has a substantially rectangular configuration as shown by dotted line 202. An imaginary median line 204 bisects blank 200 into right and left halve portions 201*a, b*. A front head-forming portion 206 is integral with and extends from rear head-forming portion 208. Downwardly extending from and integral with front head-forming portion 206 is nose-forming portion 210. Front and rear left ear-forming portions 212*b*, 214*b* are integrally connected, the front left ear-forming portion 212*b* being integral with and extending from the left front head-forming portion 206*b*. Similarly, front and rear right ear-forming portions 212*a*, 214*a* are integral with each other, the front right ear-forming portion 212*a* extending from and being integral with the right front head-forming portion 206*a*. The right rear ear-forming portion 212*a*, extends from and is integral with the right rear head-forming portions 208*a*.

A pair of cuts 220 are formed in the rear head-forming portion 208*a* as seen in FIG. 5*a* to provide a neck connecting opening as explained below. Further, right and left zigzag cuts 222*a, b* extend across front and rear head-forming portions 206, 208 as shown.

The head is formed by following the same procedure with respect to the other embodiments of this invention. Thus, referring to FIGS. 5*a* and *b*, the blank is folded so that corresponding plain and primed uppercase letters are brought into mating relationship. A second piece of material 224 is utilized in a similar manner in forming the nose, i.e., material piece 224 is connected to corresponding parts in blank 200 as is indicated by the letter indicia. Cuts 222 form flaps which are folded upwardly and cooperate with ear-forming portions 212, 214 to form the ears. Small openings 216 are formed in front head forming portions 206 to provided means for connecting eye members to the head.

Again, it is seen that a relatively small number of seams are required to sew the head together, the seams being denoted by the Roman numerals in FIGS. 5*a* and *b*. The cuts 220 formed in rear head-forming portion 208 provide a flap which is folded downwardly along fold line 226 thereby providing an opening adapted to be connected to the inner neck opening in a previously formed stuffed animal body, such as that described in connection with FIG. 4*a*.

Figure 6B:
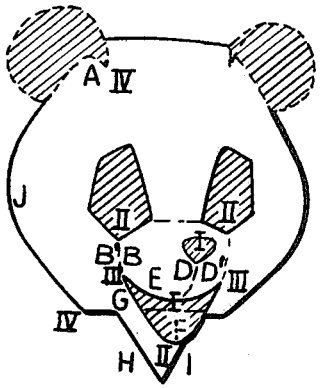
FIG. 6*b* is a perspective view of a head portion of a stuffed toy in assembled form constructed using the blank shown in FIG. 6*a.*
Figure 6A:
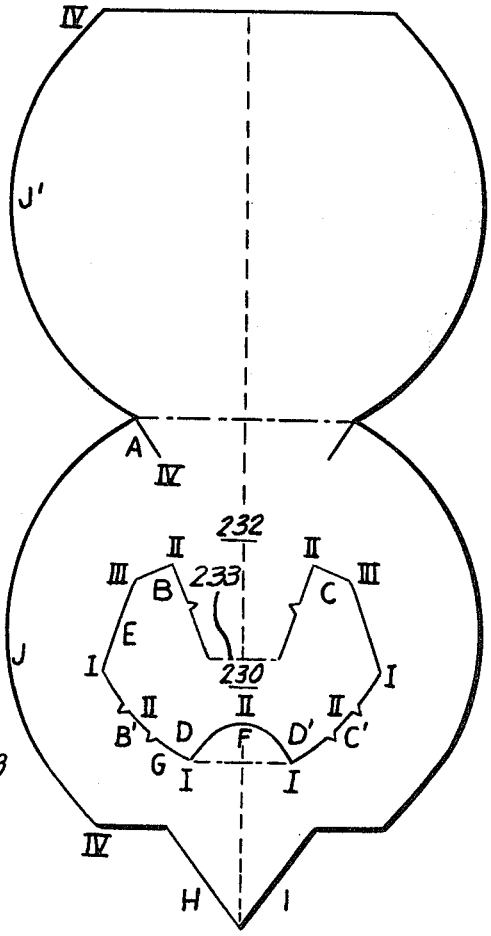
FIG. 6*a* is a plan view of a one-piece blank for forming a head portion of a stuffed toy according to a sixth embodiment of the present invention.

Referring to FIGS. 6*a* and 6*b*, another one-piece blank similar to that shown in FIG. 5*a* is shown for forming a head of a stuffed animal toy. In this case, the head is adapted for use in a panda type toy which, as known in the art, includes eye and ear areas formed of different type materials than is used for forming the head itself. To facilitate the provisions of at least the eye areas as well as to form the nose or snout of the head, an area 230 is defined which is to be partially cut from the blank and outwardly folded therefrom along fold line 233. Area 230 is folded as indicated by the upper case lettering associated with it forming the snout as seen in FIG. 6*b* as well as the areas for eye materials. Again, the same uppercase letter indicia is used to illustrate the procedure in folding the blank shown in FIG. 6*a* to achieve the head shown in FIG. 6*b*. It is believed that the drawings and accompanying indicia will be readily understood by one skilled in the art to accomplish this fold operation.

Figure 7A:
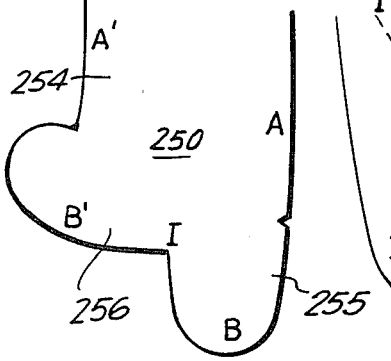
FIG. 7*a* is a portion of a blank for forming a leg portion illustrating a shape reconstitution step.
Figure 7B:
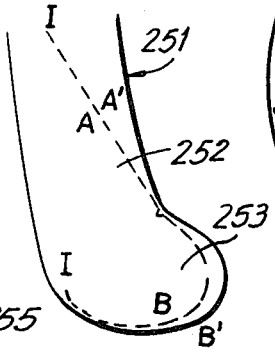
FIG. 7*b* is a leg portion constructed using the blank shown in FIG. 7*a;*

The blank 250 illustrated in FIG. 7*a* is illustrative of the manner in which the fabric can be "folded" while distorting the outer perimeter thereof to achieve a desired shape. This is described hereinabove as "shape-reconstitution design" in connection with FIGS. 3*a* and 3*b*. The particular blank shown in FIG. 7*a* is used in the construction of the leg portion of a stuffed toy. It is seen that the blank itself is not symetrically formed. However, upon appropriately "folding" the blank as indicated by the upper case indicia while bringing the corresponding edge portions thereof into mating relationship with corresponding edge portions, as shown in FIG. 7*b*, the leg portion is formed. In general, such blank sections are used in forming limbs of soft toys which include a main member and a terminal member which extends at an angle to the main member. Thus, referring to FIGS. 7*a* and 7*b*, blank 250 is used in forming limb 251 which includes a main member 252 and terminal member 253. Blank 250 includes a main member forming portion 254, a first terminal member forming portion 255, and a second terminal member forming portion 266. The characteristic of the "shape reconstitution process" is that the first and second terminal member forming portions extend at a calculated angle from each other. The terminal portion formed by the terminal members extends from the main member at an angle determined by the calculated angles. Thus, as seen in FIGS. 7*a, b* a 90° angle between the terminal member forming portion will bring about a 45° angle on the finished product in this particular case.

Referring now to FIGS. 8*a* and 8*b*, a one-piece blank 300 for use in making the body portion a camel type stuffed animal according to the present invention is illustrated. As denoted by dotted line 302, blank 300 is substantially rectangular in configuration. Only approximately one half of blank 300 is shown, an imaginary transversely extending median line 304 bisecting blank 300 into an upper halve portion 301*a* and a lower halve portion 301*b*, the latter of which is not shown. It is understood, however, that similarly to the previously described embodiment, halve portion 301*b* is substantially a mirror image of upper halve portion 301*a* with respect to median line 304.

The upper halve portion 301*a* of blank 300 includes a body-forming portion 306 having a pair of hump-forming sub-portions 308*a, b* integrally extending therefrom. Leg-forming portions 310*a, b* integrally extend from body-forming portion 306. The lower halve portion 301*b*, as mentioned above, is a mirror image of upper halve portion 301*a*.

Blank 300 is folded according to the upper case letter indicia noted on the drawings. More particularly, leg-forming portions 310*a, b* are folded into opposed relationship while median line 304 also serves as a fold line whereby the leg-forming portions defined on the lower halve portion 301*b* may be similarly folded. A pair of slits 312, 314 are formed adjacent leg-forming portions 310*a, b* further defining the legs formed, as best seen in FIG. 8*b*.

The blank 300 is advantageously formed so that a second blank 316 may be formed immediately adjacent to it by the same die cut 318 which forms the hump portion 308*a, b*, of blank 300.

After the body of the stuffed toy is formed, as described above, a separately formed head 320, ears 322 and tail 324 are provided to complete the construction of the stuffed toy.

Turning to FIG. 9*a* and *b*, a blank 350 for forming a turtle type stuffed animal is illustrated. Previously, in the construction of stuffed toys of the turtle type, leg-portions and head-portions were all separately formed and subsequently assembled to each other. As shown in FIG. 9*c*, the body-forming portion 355 of turtle type stuffed animals constructed using prior art blanks included a generally elliptical pattern having four openings for attachment of separately formed legs. Thus, this required the formation of four separate legs with four separate seams with an additional seaming operation to attach each leg to a respective opening. This is contrasted with the one-piece construction of the body and leg forming portion of the blank shown in FIG. 9*b*, discussed below.

Referring specifically to FIG. 9*a*, blank 350 has substantially rectangular configuration as denoted by dotted line 352. An imaginary median line 353 divides blank 350 into right and left halve portions 354*a* and *b*, respectively, the halve portions being substantial mirror images of each other with respect to median line 353.

Blank 350 includes a body-forming portion 356 which is bisected by median line 353 into right and left body-forming sub-portions 356*a, b*, respectively. Right and left first front leg forming portions 358*a, b*, extend from and are integral with right and left body-forming portions 356*a, b*. Extending from and integral with right and left first front leg-forming portions 358*a, b* are right and left second front leg-forming portions 360*a, b*.

Similarly, right and left first rear leg-forming portions 362*a, b*, extend from and are integral with right and left body-forming portions 356*a, b* respectively. Extending from and integral with right and left first rear leg-forming portions 362*a, b* are right and left second rear leg portions 364*a, b*.

An additional advantage of the particular configurations of blank 350 is that a head forming portion 370 is at least partially defined by the same die cuts defining the left and right front leg-forming portions 358*a, b*, 360*a, b* and the front segment of body-forming portion 356.

Again, similar to the previously discussed embodiments, the blank 350 is folded according to the indicia noted on FIG. 9*a* resulting in the construction of the body and head of the turtle type stuffed toy as shown in FIG. 9*b*. A piece of material 372, shown in phantom in FIG. 9*b*, may then be sewn over body-forming portion 356 to form the shell. Again, an important advantage of the one-piece construction of this invention is the reduction in the number of seams necessary to sew the body portion together.

Referring now to FIG. 10*a* and *b*, yet another embodiment of the present invention is illustrated for forming a three dimensional stuffed toy in the form of a seal. A one-piece blank 400 is provided having a substantially square configuration as denoted by dotted line 402. One piece blank 400 is substantially bisected by an imaginary median line 404 into right and left body-forming portions 406*a, b*, respectively. Integral with and extending from right and left body forming portions 406*a, b*, are right and left head-forming portions 408*a, b*. A central head-forming portion 408*c* extends from and is integral with the right and left head-forming portions 408*a, b*. Similarly, right and left front leg-forming portions 401*a, b*, extend from and are integral with right and left body-forming portions 406*a, b*, while right and left rear leg-forming portions 412*a, b*, similarly extend from and are integral with right and left body-forming portion 406*a, b*. An opening 414 is provided preferably along median line 404 for stuffing the toy subsequent to seaming and shaping the back of the neck.

Blank 400 is folded according to the indicia marked on FIG. 10*a* in a manner similar to the embodiments described above. It should be pointed out again that the present invention permits the construction of a three dimensional stuffed toy using a blank having a minimum of separate parts (herein only a single part) and with a minimum of seaming operation (as denoted by the Roman numeral shown on the drawings).

Further, as illustrated in the FIG. 10 embodiment, the blanks according to the present invention include median lines which may extend diagonally across the rectangular pattern as well as transversely (FIG. 8*a*) or vertically.

Obviously, numerous modifications and variations are possible within the scope of the present invention. Therefore, it is understood that within the scope of the appended claims, the invention may be practiced otherwise than as specifically described herein.

I claim:

1. A one-piece substantially rectangular fabric blank for forming the exterior of a soft toy of the three-dimensional type in its entirety, said blank including at least two single cuts, each said cut producing edges of a plurality of forming portions interrelated in a substantially jig-saw puzzle relationship, comprising: a rear body-forming portion, a rear head-forming portion upwardly extending from and integral with said rear body-forming portion, said rear body and head forming portions each being bisected by a single, imaginary median line dividing each of said portions into respective right and left sub-portions, a left front head-forming portion extending transversely from and integral with said left rear head-forming sub-portion, a right front head-forming portion extending transversely from and integral with said right rear head-forming sub-portion, a left rear arm-forming portion extending transversely from and integral with said left rear body-forming sub-portion, a left front arm-forming portion extending downwardly from and integral with said left rear arm-forming portion, a right rear arm-forming portion extending transversely from and integral with said right rear body-forming sub-portion, a right front arm-forming portion extending downwardly from and integral with said right rear arm-forming portion, a left front body-forming portion integral with and extending from said left rear body-forming sub-portion, a left leg-forming portion integral with and extending from said left front body-forming portion, a right front body-forming portion extending from and integral with said right rear body-forming sub-portion and a right leg-forming portion integral with and extending from said right front body-forming portion, said blank being adapted to be folded so that the outer edges of said left and right front head portions mutually mate, so that the lower edges of said left and right front head-forming portions and the outer edges of said left and right front body-forming portions respectively mutually mate, the lower edges of said left and right front body-forming portions mutually mate and each leg-forming portion having edges adapted to mate, all of said mating edges being joinable in a seam.

2. A one-piece fabric blank as recited in claim 1 wherein the portions and sub-portions of said blank extending leftwardly of said median line is a substantially mirror image of the portion and sub-portions of said blank extending rightwardly of said median line.

3. A one-piece fabric blank as recited in claim 1 wherein each leg-forming portion includes at least one vent cut and side edges having differing shapes, said side edges adapted to mate and be joined together.

4. A one-piece fabric blank as recited in claim 1 including a pair of substantially sinusoidal cuts in said blank, each sinusoidal cut defining the upper and lower edges of one of the left and right front body-forming portions and front arm-forming portions.

5. A one-piece fabric blank as recited in claim 1 further including a left rear ear-forming portion extending from and integral with said left rear head-forming sub-portion, a left front ear-forming portion integral with and extending from said left rear ear-forming portion and said left front head forming portion, a right rear ear forming portion extending from and integral with said right rear head forming sub-portion, and a right front ear forming portion integral with and extending from said right rear ear-forming portion and said right front head-forming portion.

6. A one-piece substantially rectangular fabric blank for forming the exterior of a soft toy of the three-dimensional type in its entirety, said blank including a plurality of forming portions interrelated in a substantially jig-saw puzzle relationship, comprising: a rear body-forming portion, a rear head-forming portion upwardly extending from and integral with said rear body-forming portion, said rear body and head forming portions each being bisected by a single, imaginary median line dividing each of said portions into respective right and left sub-portions, a left front head-forming portion extending transversely from and integral with said left rear head-forming sub-portion, a right front head-forming portion extending transversely from and integral with said right rear head-forming sub-portion, a left rear arm-forming portion extending transversely from and integral with said left rear body-forming sub-portion, a left front arm-forming portion extending downwardly from and integral with said left rear arm-forming portion, a right rear arm-forming portion extending transversely from and integral with said right rear body-forming sub-portion, a right front arm-forming portion extending downwardly from and integral with said right rear arm-forming portion, a left front body-forming portion integral with and extending from said left rear body-forming sub-portion, a left leg-forming portion integral with and extending from said left front body-forming portion, a right front body-forming portion extending from and integral with said right rear body-forming sub-portion and a right leg-forming portion integral with and extending from said right front body-forming portion, said blank being adapted to be folded so that the outer edges of said left and right front head portions mutually mate, so that the lower edges of said left and right front head-forming portions and the outer edges of said left and right front body-forming portions respectively mutually mate, the lower edges of said left and right front body-forming portions mutually mate and each leg-forming portion having edges adapted to mate, all of said mating edges being joinable in a seam, and further including a pair of single substantially sinusoidal cuts in said blank, each sinusoidal cut defining the upper and lower edges of one of the left and right front body-forming portions and front arm-forming portions.

* * * * *